United States Patent [19]

Yang

[11] Patent Number: 4,807,803

[45] Date of Patent: Feb. 28, 1989

[54] PACKING STRUCTURE FOR COLLAPSIBLE BASKET HOLDER

[75] Inventor: Onie Yang, Taipei, Taiwan

[73] Assignee: Ulike Corporation, Taipei, Taiwan

[21] Appl. No.: 38,339

[22] Filed: Apr. 15, 1987

[51] Int. Cl.[4] ..... B65D 5/02

[52] U.S. Cl. ..... 229/40; 206/491; 206/577

[58] Field of Search ..... 206/577, 491, 492; 229/40

[56] References Cited

U.S. PATENT DOCUMENTS

| | | | |
|---|---|---|---|
| 1,974,038 | 9/1934 | Baxter | 206/491 |
| 2,008,838 | 7/1935 | Reed | 206/491 X |
| 3,521,812 | 7/1970 | Moers et al. | 206/491 X |
| 4,332,322 | 6/1982 | Jaeschke et al. | 206/491 |

FOREIGN PATENT DOCUMENTS

| | | | |
|---|---|---|---|
| 2804997 | 8/1979 | Fed. Rep. of Germany | 229/40 |

*Primary Examiner*—William Price

*Attorney, Agent, or Firm*—James G. Staples

[57] ABSTRACT

A packing structure for a collapsible basket holder composed of a sheet of rectangular cardboard which is foldable into a box-like structure comprising two main walls—a top wall and a bottom wall—while the two side ends thereof are left opened. It is characterized by said bottom wall being provided with a plurality of lug members and mating slits so that said box-like structure is openable for packaging a collapsible basket holder, and a trough structure located in the upper central portion of said box-like structure for partially revealing a top horizontal member of said collapsible basket holder. It is also characterized in that said collapsible basket holder is portable with one hand, and said packing structure is not weighted with said collapsible basket holder at all.

1 Claim, 4 Drawing Sheets

Fig. 1.
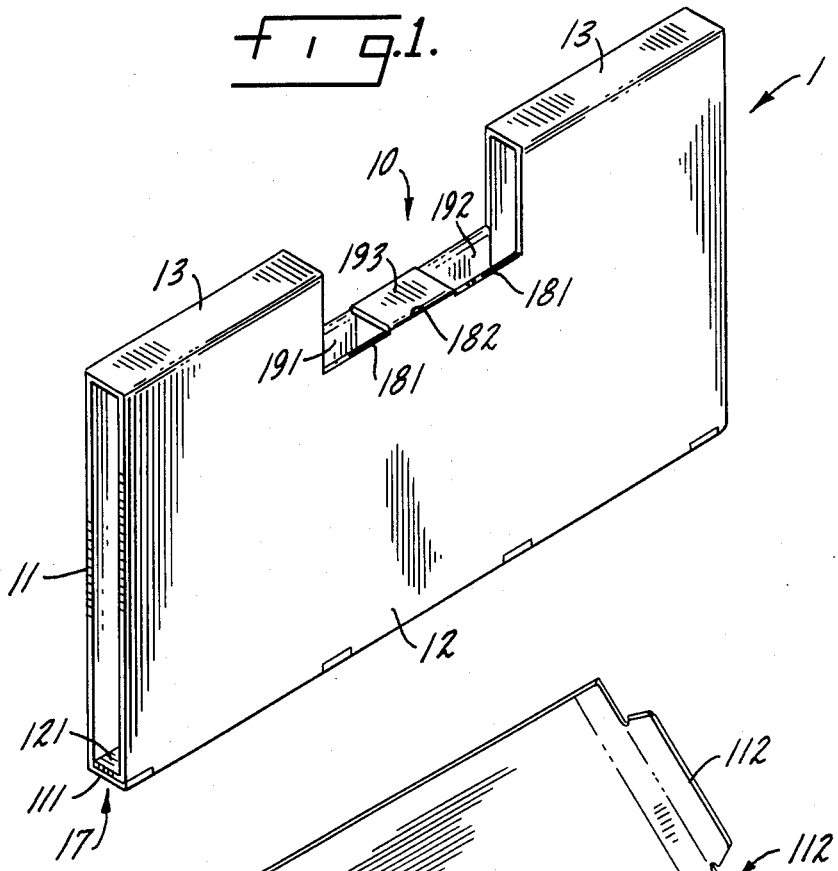
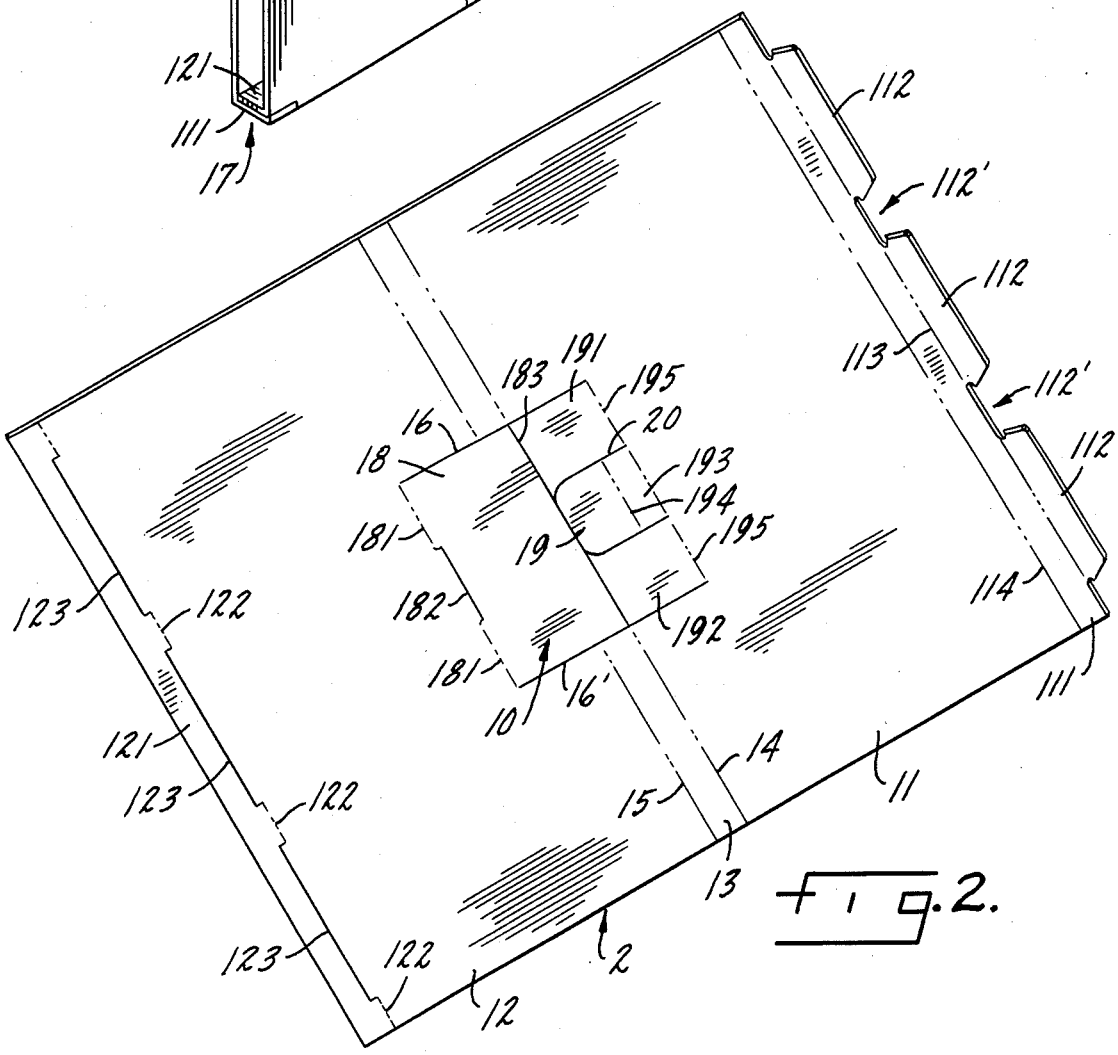
Fig. 2.

1
2
11
114
16
195
191
20
19
194
193
16'
195
181
181'
182
192
14
13
15
112
113
112'
112
112'
18
183'
111
112
101
122
123
12
121
100
106
102
103
102
107
104
104
103
101

PACKING STRUCTURE FOR COLLAPSIBLE BASKET HOLDER

BACKGROUND OF THE INVENTION

1. Field of the Invention

The present invention relates to a packing structure in general, and more particularly to the packing structure for a collapsible basket holder.

2. Description of the Prior Art

It is known to the public that basket holder may be packed by means of carton in a general way after having been suitably assembled. Alternatively, it may be packed element by element.

Obviously, packing according to the first conventional technique will make a basket holder bulky in volume and takes up much space for storage. Bulky volume often results in high costs of transportation. As regards the second conventional packing technique, the elements of the basket holder must be packed individually. Customers are greatly troubled with the frequent occurrence of shortage of packing. Additionally, a basket holder packed in this way does not present a pleasing visual configuration, and appetite for purchase cannot be promoted.

SUMMARY OF THE INVENTION

A packing structure for collapsible basket holder composed of a sheet of rectangular cardboard which is foldable into a box-like structure comprised of two main walls, a top wall, and a bottom wall, while the two ends thereof are left opened. It is characterized by the bottom wall being constructed by folding the free bottom ends of the two main walls in a laminated relationship, and a plurality of lug members integral with one of the free bottom ends of the two main walls may enter into an engagement with the meeting slits located on the other one of the free bottom ends of the two main walls, a trough structure located in the upper central portion of the box-like structure for partially revealing a top horizontal member of a collapsible basket holder contained in the box-like structure that the collapsible basket holder is portable with one hand and the box-like structure is not weighted with the collapsible basket holder.

In the preferred embodiment, the packing structure of the present invention further comprises a tongue member originating from one of the two main walls at the bottom of the trough structure, and a mating slit located on the other one of the two main walls at the bottom of the trough structure. The tongue member straddles the two main walls and is flush with the bottom of the trough structure. The tongue member substantially struts the central portions of the two main walls in a parallel relationship when the free end of the tongue member engages with the mating slit. It is further characterized by the mating slit at the bottom of the trough structure being lightly indented for facilitating the alignment of the tongue member. In addition, lug members at the bottom wall of the box-like structure are each bilaterally matched, while the mating slits are each indented. The catching structures resulting from the matching lug members firmly catch the protrusions resulting from the indention of the mating slits when the lug members suitably engage them.

OBJECTS OF THE INVENTION

Accordingly, the present invention provides a packing structure for collapsible basket holder in the form of a box-like structure which is portable for transporting purpose.

Another object of the present invention so to provide an improved packing structure to achieve integral packing for the collapsible basket holder.

Another object of the present invention is to provide an improved packing structure which is simple in construction and convenient for packing collapsible basket holder without the help of any tool.

Further objects and advantages of this invention will become apparent from the following description of the preferred embodiment when taken together with the accompanying drawings.

BRIEF DESCRIPTION OF THE DRAWINGS

In the drawings:

FIG. 1 is a perspective view showing the packing structure of the preferred embodiment according to the present invention;

FIG. 2 is a top view of the packing structure shown in FIG. 1 when it is in an unfolded position;

DESCRIPTION OF THE PREFERRED EMBODIMENT

Figure 3:
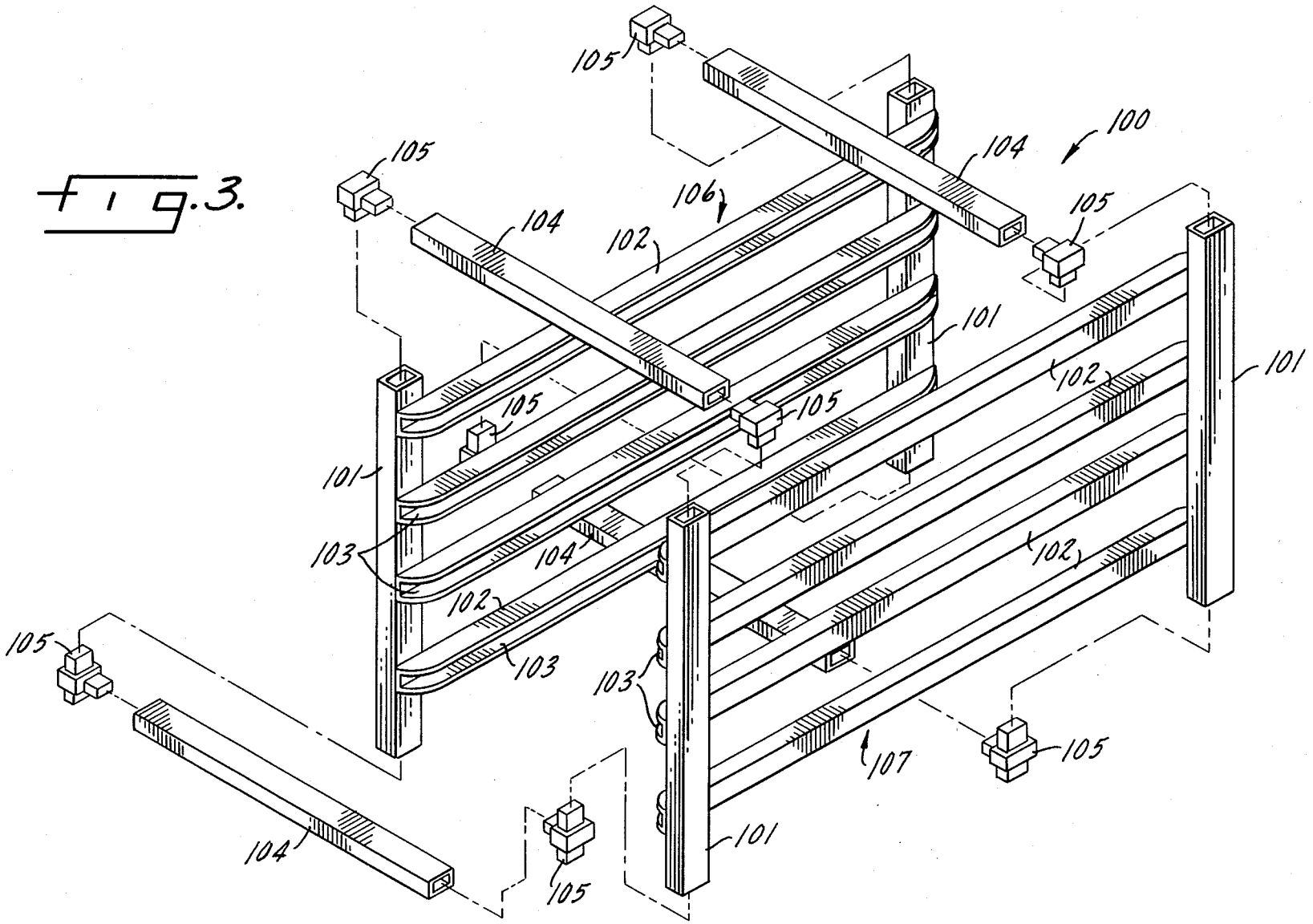
FIG. 3 is a perspective view showing a collapsible basket holder.

Referring now to FIG. 1 of the drawings, there is shown generally a box-like structure 1 comprising main walls 11 and 12, top wall 13, and an openable bottom wall 17 for packing a collapsible basket holder 100 (see FIG. 3). A trough structure 10 located in the upper central portion of the box-like structure 1 for partially revealing a top horizontal member of the collapsible basket holder 100 that the same is portable for transportation. A detailed description will follow later. For the purpose of strutting the main walls 11 and 12 in a substantially parallel relationship, a tongue member 19 and mating slit 182 (see FIG. 2) are provided at the bottom of the trough structure 10. Additionally, in order to provide an openable bottom wall 17 for the box-like structure 1, the bottom ends 111 and 121 of main walls 11 and 12 are respectively provided with a plurality of lug members 112 and mating slits 123. Detailed descriptions will be given later.

FIG. 2 shows the packing structure 1 of FIG. 1 in an unfolded position. It is noted that the packing structure 1 is constructed of a sheet of rectangular cardboard 2 which may be folded along lines 14 and 15. The trough structure 10 is exactly located in the central portion of cardboard 2 by cutting along lines 16, 16' and 183 in sequence with known cutting apparatus. Further cutting is made along line 20 to obtain a tongue member 19 integral with main wall 11. The mating slit 182 relative to the tongue member 19 is located along foldable line 181 on main wall 12.

When the cardboard 2 in FIG. 2 is folded into the box-like structure 1 of FIG. 1, the redundant portion 18, 191 and 192 resulted from th afore-said cutting may be forced into the box-like structure 1 by hands along respective foldable lines 181 and 195, the tongue member 19 is thus guidable to the mating slit 182 without retardation. To achieve engagement, the tongue member 19 should be folded along line 194 to let the free end thereof positioned in alignment with the mating slit 182. The indentation of the mating slit 182 is very helpful for the afore-said alignment. With finger-tips holding the tongue member 19, a light push is then applied until foldable line 194 comes to meet the mating slit 182 and the free end of tongue 19 is thus pinched between the inner surface of main wall 12 and the redundant portion 18. The portion 193 straddling onto main walls 11 and 12 is substantially flush with foldable line 181 and 195 to strut the central portions of main walls 11 and 12 in a substantially parallel relationship by having a width corresponding to the width of top wall 13.

In order to provide an opening between wall 17 for the box-like structure 1, the bottom end 111 of main wall 11 is provided with a plurality of lug members 112 which are foldable along line 113. For the purpose of engagement, mating slits 123 relative to the lug members 112 are located at the bottom end 121 of main wall 12. The mating slits 123 are similar in constructions to the mating slit 182, but they are indented in an opposite direction relative to the slit 182. As indicated in FIG. 2, lug members 112 are each bilaterally matched to form catching structures 112' when the bottom ends 111 and 121 of main walls 11 and 12 are folded along foldable line 114 and the aligned mating slits 123 respectively in a laminated relationship to form the bottom wall 17. Lug members 112 suitably engage the associated mating slits 123 as shown in FIG. 1. Because top wall and bottom wall 17 are equal in width, main walls 11 and 12 are strutted in a substantially parallel relationship in combinations with the tongue member 19 engaging the mating slit 182. The bottom wall 17 thus formed is openable only by the disengagements of lug members 112 from the mating slits 123.

FIG. 3 is a perspective view briefly showing a collapsible basket holder 100 consisting of symmetric frames 106 and 107, the symmetric frames are jointed by means of cross bars 104 in combination with plug-in connectors 105. In the preferred embodiment, frames 106 and 107 each comprise four runners 102 having rough-like cross-section 103 and evenly spaced with both ends attached to respective vertical members 101. Apparently, pluralities of the basket holder 100 may be stacked vertically for holding more baskets (not shown) if desired.

Figure 4:
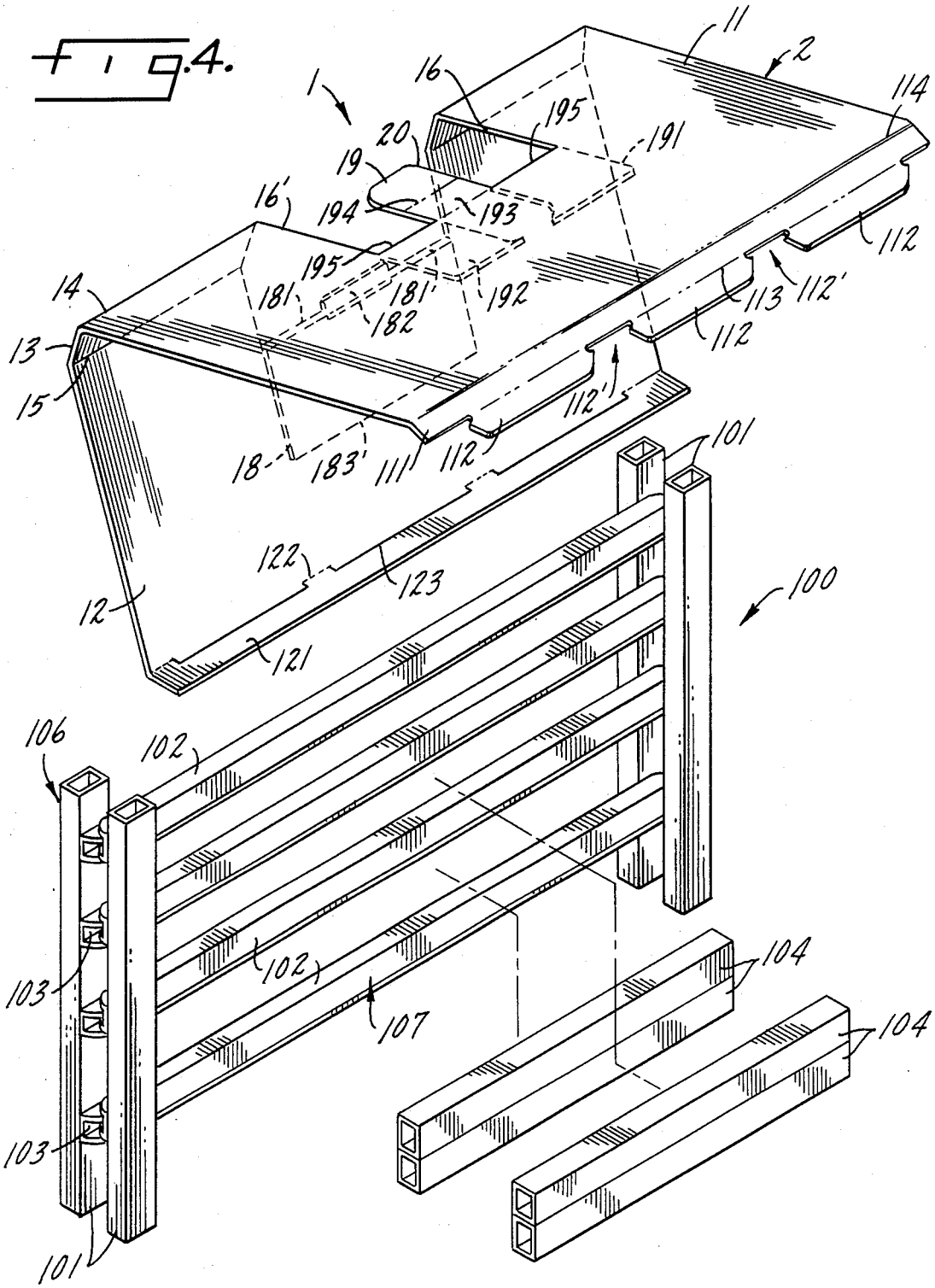
FIG. 4 is a perspective view showing the basket holder of FIG. 3 as folded up and packed with the packing structure of FIG. 1.
Figure 5:
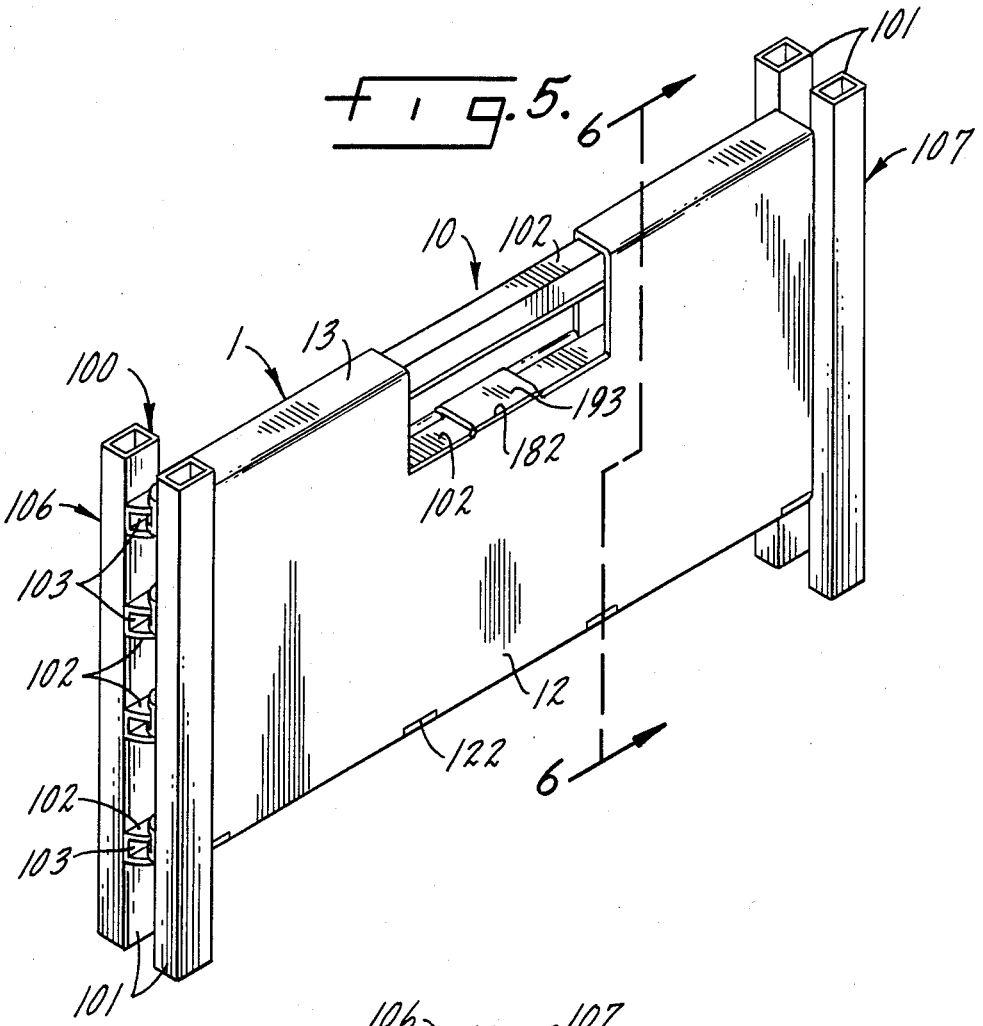
FIG. 5 is a perspective view showing the folded basket holder of FIG. 4 as packed with the packing structure of FIG. 1.

For packing, as illustrated in FIG. 4, the box-like structure 1 is half-opened, while the basket holder 100 of FIG. 3 is collapsed by removing the plug-in connectors 105 and the cross boards 104 thereafter, the symmetric frames 106 and 107 are then laid to overlap each other in a manner that the opposite runners 102 are interlocked with trough cross-sections 103 It is appreciated that the interlocked runner 102 in the overlapped frames 106 and 107 occupy the same size as the box-like structure 1 that the same may be compactly packed with vertical members 101 left outside the opened side ends of the box-like structure 1 as shown in FIG. 5. FIG. 5 also shows the trough structure 10 in the box-like structure 1 partially revealing the upper most interlocked runners 102 of the packed frames 106 and 107, by which the packed basket holder 100 is portable with one hand for transportation. As stated earlier, trough structure 10 is centrally located at the top wall 13 of the box-like structure 1. This will cause the carrier of the basket holder 100 to grip the central portion of the uppermost interlocked runners 102 accordingly, the basket holder with the packing structure of the present invention may be carried with better balance.

Figure 6:
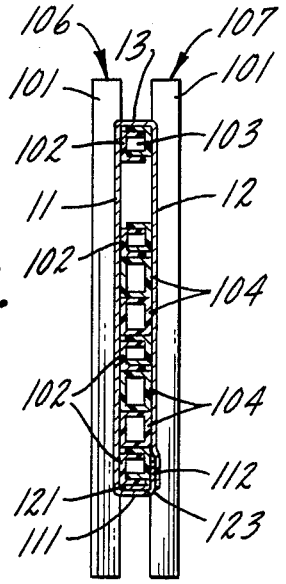
FIG. 6 is a cross-sectional view of FIG. 5 along line 6—6 showing the element disposal of the basket holder in the packing structure of FIG. 5.

It can be seen in FIG. 4 that the cross bars 104 are stacked in two groups and are going to rest on the lower two interlocked runners 102 respectively as indicated by the chain lines. The two groups of cross bars 104 may be secured to the afore-said runners with bindings such as adhesive tape; however, to avoid distrubing the afore-said balance, they should be first centered with the overlapped frames 106 and 107. Although its is not shown in FIG. 4, the plug-in connectors 105 may be remained in the open ends of the cross bars 104 to achieve integral packing. FIG. 6 is a cross-sectional view of FIG. 5 along line 6—6 clearly showing the element disposal of the basket holder in the packing structure of the present invention according to the manner disclosed in the preferred embodiment.

From the foregoing descriptions and illustrations, it is evident that the present packing structure is coupled with a simplicity of design which contributes to a lower cost of manufacture. In addition, the compact structure of the present invention thoroughly solves the problem inherent in the conventional packing structures. The basket holder with the present packing structure is thereby immune from the high cost of transportation. Furthermore, the present packing structure is not at all weighted with the basket holder contained therein, the present packing structure therefore may be remain intact, which is advantageous to promoting purchase.

I claim:

1. A packing structure for a collapsible basket comprising a sheet of rectangular cardboard which may be folded into a box-like structure, said structure comprising two main walls, a top wall, and a bottom wall, said packing structure being characterized by a plurality of lug members and mating slits located on said bottom wall of the packing structure, said bottom wall being comprised of the bottom end of said two main walls, and being constructed by folding said bottom ends in a layered relationship and joining said plurality of lug members with said matching and mating slits, said packing structure being further characterized by an open void section located in the upper central portion of the box-like structure, said open void section partially revealing a top horizontal member of said collapsible basket, a tongue member being located on one side of said open void section and a mating slit being located on the other side of said open void section, said tongue member being constructed to straddle the open void section and to engage said mating slit, said top horizontal member of said collapsible basket being revealed such that it may be used as a handle for the combined collapsible basket and packing structure for said collapsible basket.

* * * * *